US005260531A

United States Patent [19]

Yarbrough et al.

[11] Patent Number: 5,260,531

[45] Date of Patent: Nov. 9, 1993

[54] EXPLOSION-PROOF SWITCH WITH ARC EXTINGUISHING GASEOUS BYPRODUCT VENTING FEATURE AND SWITCH CONTACT

[75] Inventors: Garrett S. Yarbrough, Manilus; Paul J. Bartlett, Camillus, both of N.Y.

[73] Assignee: Cooper Industries, Houston, Tex.

[21] Appl. No.: 856,134

[22] Filed: Mar. 23, 1992

[51] Int. Cl.[5] ..... H01H 33/02; H01H 1/20; H01H 9/02

[52] U.S. Cl. ..... 200/144 R; 200/16 A; 200/243

[58] Field of Search ..... 200/16 A, 144 R, 241-243, 200/293-307

[56] References Cited

U.S. PATENT DOCUMENTS

| | | | |
|---|---|---|---|
| 1,906,085 | 4/1933 | Norviel | 200/16 D |
| 2,756,291 | 7/1956 | Peter | 200/16 A |
| 2,758,169 | 8/1956 | Weide | 200/450 |
| 3,238,341 | 3/1966 | Haydu | 200/243 |
| 3,272,949 | 9/1966 | Lawrence | 200/243 |
| 3,391,359 | 7/1968 | Arneberg et al. | 335/115 |
| 3,482,064 | 12/1969 | Osika | 200/16 D |
| 3,586,810 | 6/1971 | Brown et al. | 200/302.2 |
| 3,699,276 | 10/1972 | Atakkaan | 200/16 A |
| 4,029,924 | 6/1977 | Frank et al. | 200/307 |
| 4,086,455 | 4/1978 | Takahashi | 200/447 |
| 4,095,059 | 6/1978 | Nishioka et al. | 200/5 B |
| 4,203,084 | 5/1980 | Yamaguchi et al. | 335/202 |
| 4,260,863 | 4/1981 | Appleton | 200/144 R |
| 4,306,123 | 12/1981 | Taylor | 200/16 A |
| 4,401,863 | 8/1983 | Lemmer et al. | 200/16 A |
| 4,620,061 | 10/1986 | Appleton | 200/144 R |
| 4,914,262 | 4/1990 | Appleton | 200/8 R |

*Primary Examiner*—J. R. Scott
*Attorney, Agent, or Firm*—Kenyon & Kenyon

[57] ABSTRACT

An electrical switch and switch contact are disclosed, both of which are advantageous for use in an environment containing explosive gases or vapors. The switch housing is designed so that the two joints where explosive gases or vapors can enter or exit into the switch interior can cool any hot gases escaping from the switch interior. Therefore, if any explosive gases or vapors are ignited by an arc in the switch interior, they are cooled during their exit from the switch, so that they cannot ignite the explosive environment outside the switch. This is done using a labyrinthine path between the two switch housing members, and a lengthy metal-to-metal, metal-to-ceramic, or ceramic-to-ceramic path between the switch actuator and the switch housing. The contact is designed such that it has a greater flexural length, without requiring a substantial increase in the housing body volume. This allows a smaller amount of hazardous gas or vapor to come into contact with a potential arc. The contact design allows a good degree of overtravel and a contact cleaning action, both of which contribute to the reliability of the electrical connection made by the switch.

14 Claims, 5 Drawing Sheets

EXPLOSION-PROOF SWITCH WITH ARC EXTINGUISHING GASEOUS BYPRODUCT VENTING FEATURE AND SWITCH CONTACT

BACKGROUND OF THE INVENTION

The invention relates to electrical switches, and specifically to electrical switches which are used in an environment containing explosive vapors or gases.

The use of electrical equipment in areas where explosive vapors or gases are present presents a potentially hazardous situation. Since many electrical components can cause arcing, there is the distinct possibility that the explosive vapors or gases could be ignited by an arc, causing an explosion. For this reason, safety codes require that certain precautions be taken when any electrical system which includes an arcing device is installed in an area containing explosive vapors or gases.

Electrical switches are one type of electrical device which can generate an arc; therefore safety measures must be taken if an electrical switch is to be used in an environment containing explosive gases or vapors. Generally, three techniques are used to allow an electrical switch to be safely used in an explosive environment. One technique is to install a conventional electrical switch in an explosion-proof enclosure designed to contain the internal explosions of the gases. This requires all conduit or cable entrances to the enclosure be sealed to prevent the propagation of the explosion. Conduit or cable seals and the additional installation labor add cost to the installation.

Another technique used is to install an electrical switch that is factory sealed. This eliminates the need for conduit or cable seals, in most cases. Factory sealed switches can be either hermetically sealed or contained in an explosion-proof enclosure. Generally, hermetically sealed switches have limited electrical ratings and are expensive. Factory sealed switches contained in their own explosion-proof enclosures do not have the limited electrical rating of the hermetically sealed switch, but have the disadvantage of being relatively costly.

SUMMARY OF THE INVENTION

The drawbacks of the above-listed arrangements are overcome by the apparatus of the present invention.

The present invention is an explosion-proof switch containing a combination of features which make the switch both safe and economical. In the switch of the present invention, the switch body is constructed of a plastic material and allows the incursion of vapors. The joints through which vapors can encroach into the switch housing are designed so that any gases or vapors ignited in the switch body will be cooled sufficiently on their escape from the interior so that they will be unable to ignite the hazardous vapors in the exterior environment. This is done through the use of a metal-to-metal faced, metal-to-ceramic faced, or ceramic-to-ceramic faced surface contact at the actuator joint. A labyrinthine path is used at the housing joint. The switch is also designed using a moving electrical contact that reduces the interior volume of the switch, thus reducing the amount of gas or vapor in the vicinity of any arc. The contact is effective in providing sufficient overtravel and a wiping action, thus allowing more reliable operation of the switch contacts.

DETAILED DESCRIPTION

Figure 1:
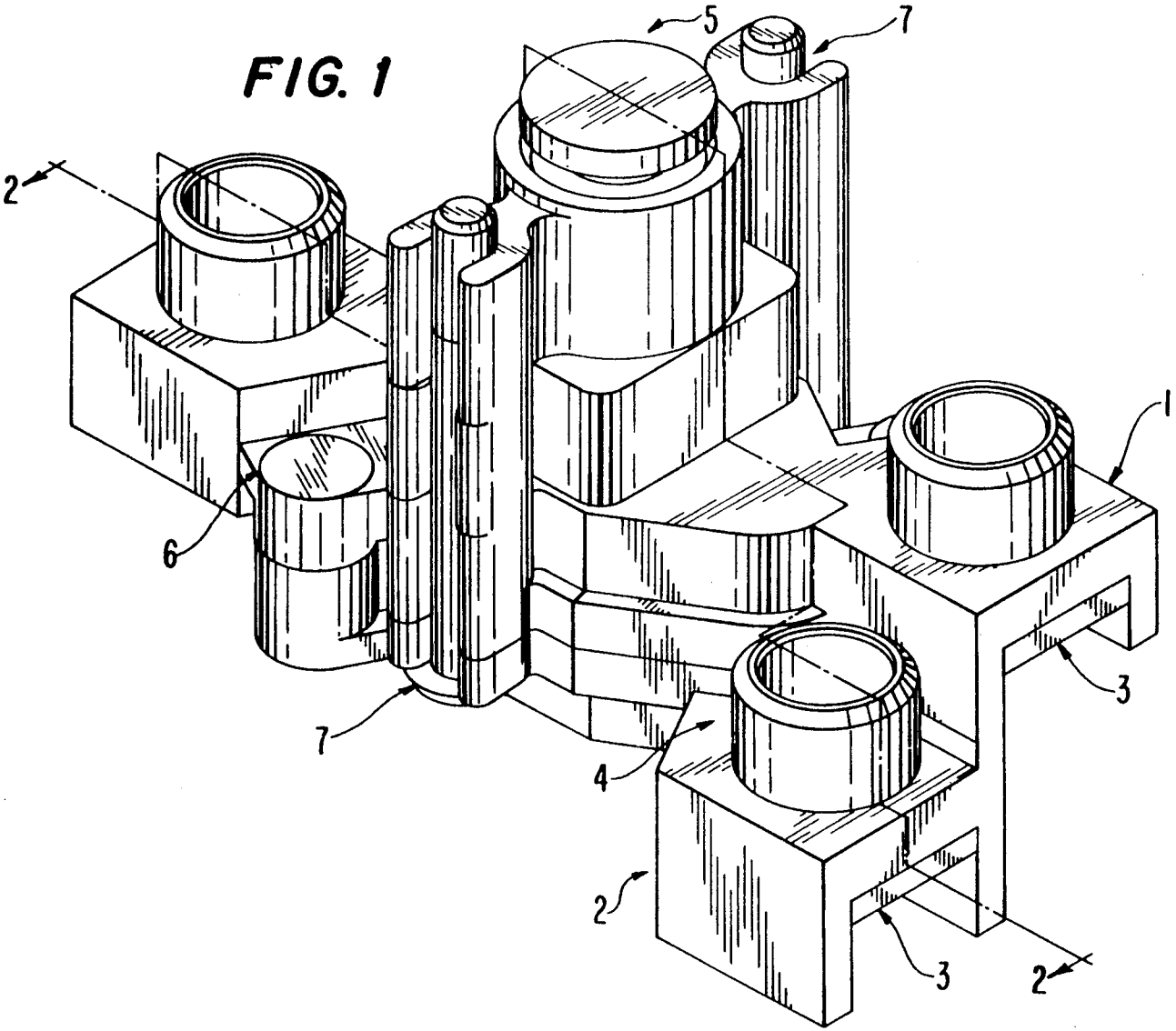
FIG. 1 is a perspective view of the switch of the present invention.

As illustrated in FIG. 1, the electrical switch of the present invention includes upper 1 and lower 2 housing portions, upper terminal contacts 3, lower terminal contacts 4, actuator cap 5, securing rivets 6, and mounting screws 7. Securing rivets 6 are used to secure upper and lower housing portions 1 and 2 to one another, while mounting screws 7 are used to secure the switch structure to a suitable switch enclosure. Both upper terminal contacts 3 and lower terminal contacts 4 are offset from the centerline of switch housing portions 1 and 2.

Figure 2:
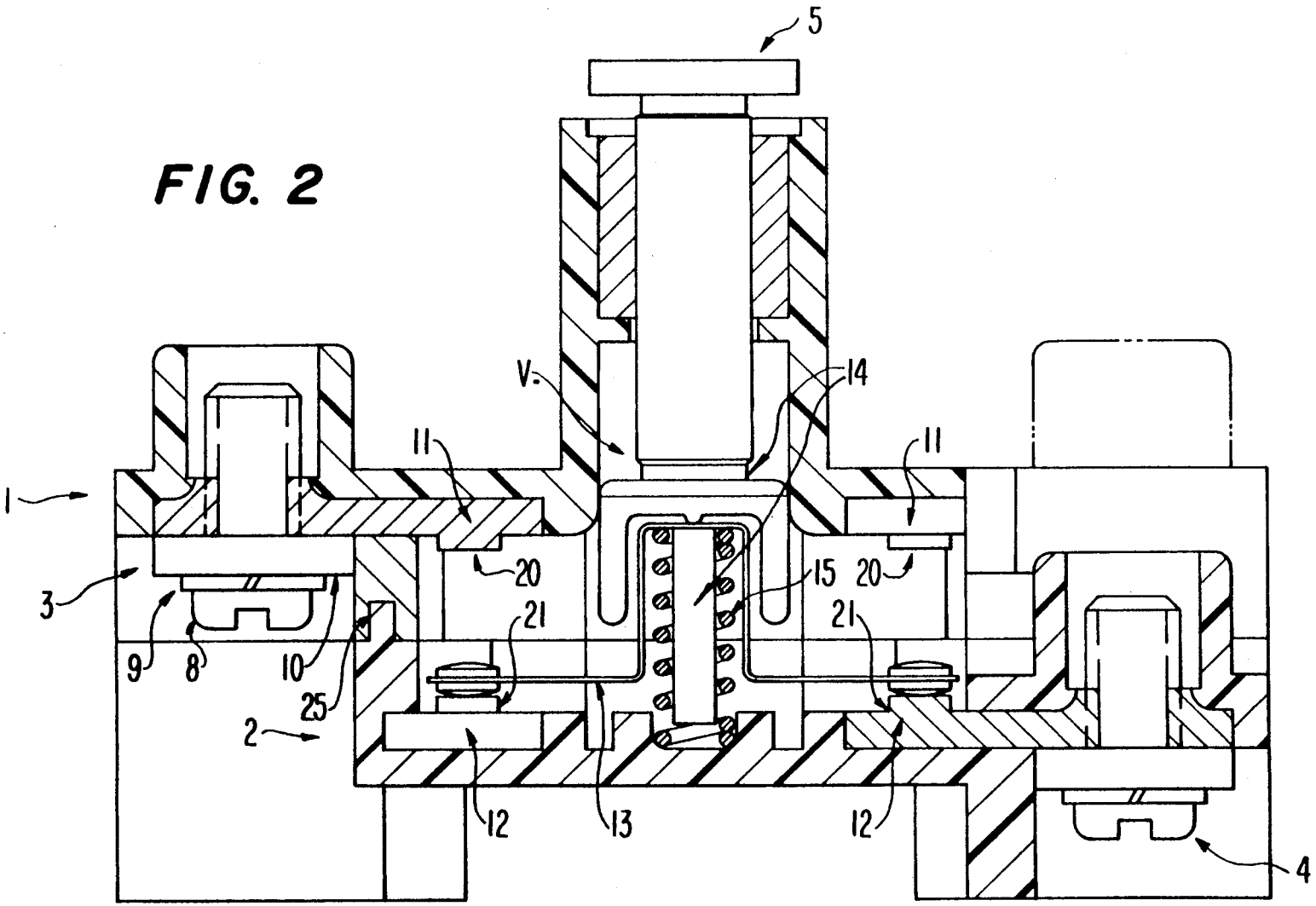
FIG. 2 is a cross-sectional view of the switch of the present invention.

FIG. 2 illustrates the interior features of the switch of the present invention. As can be seen, each terminal contact 3 or 4 consists of screw 8, lockwasher 9, and pressure plate 10, which are used to connect electrical wiring (not shown) to stationary contacts 11 or 12. This is done in a known manner by wrapping an exposed wire end around the shaft of screw 8 and tightening the screw such that the wire is secured under pressure plate 10. The gap between the stationary contacts 11 or 12 is bridged by movable contact 13. Thus, when movable contact 13 is in an upper position (not shown), it bridges the gap between stationary contacts 11, electrically connecting the upper terminal contacts 3 and any wiring connected thereto. Similarly, when movable contact 13 is in a lower position (as shown in FIG. 2), it bridges the gap between stationary contacts 12, electrically connecting the lower terminal contacts 4 and any wiring connected thereto.

Movable contact 13 is moved from an upper to a lower position by actuation of actuator cap 5, which can be physically connected to any suitable actuation device, or could be actuated by hand. Actuator cap 5 is connected to plunger shaft 14. Plunger shaft is spring biased into an upwardly-extending position by a coil spring 15. Movable contact 13 is retained upon plunger shaft 14 by means of the upward force provided by coil spring 15. Normally, therefore, movable contact 13 and plunger shaft 14 will be urged upwardly by spring 15, such that movable contact 13 is in physical contact with upper stationary contacts 11, providing an electrical connection between these contacts. Physical force applied to actuator cap 5 will urge plunger shaft 14 downwards, such that a force sufficient to overcome the biasing of spring 15 will cause the movable contact 13 into physical contact with lower stationary contacts 12, as shown in FIG. 2, providing an electrical connection between these contacts.

Figure 3A:
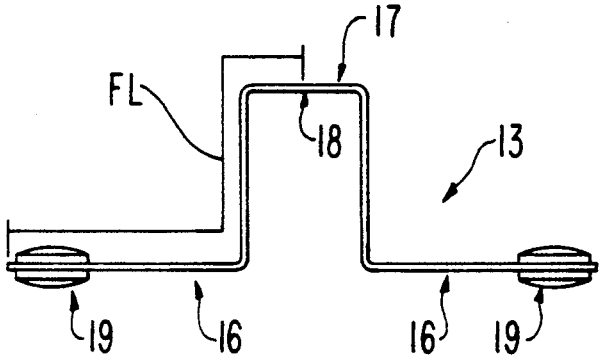
FIGS. 3*a* and 3*b* are top and side views of the switch contact of the present invention.
Figure 3B:
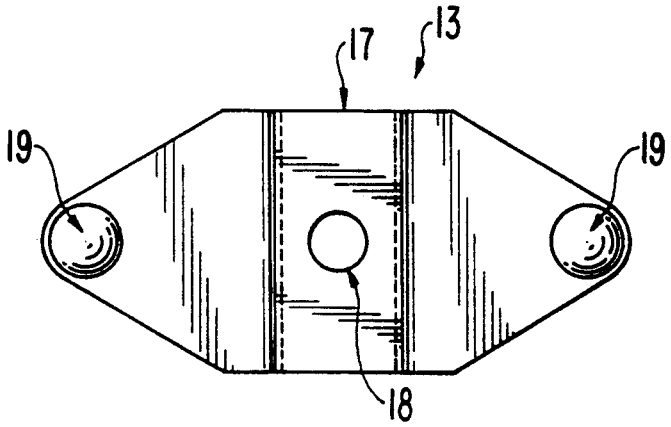

The design of movable contact 13 provides advantageous operation in an explosion-proof environment, and also provides superior operation as compared to other conventional switches. As shown in FIGS. 3*a* and 3*b*, movable contact contains two L-shaped arms 16 connected by a cross-piece 17. Both L-shaped arms 16 and cross-piece 17 are constructed of a thin sheet of resilient metallic material, such as copper. In the center of cross-piece 17 is a opening 18 for receiving plunger shaft 14. The two sections of each L-shaped arm 16 are arranged perpendicular to one another, and the cross-piece 17 is perpendicular to both the sections of the L-shaped arms 16 to which it is connected. The extreme ends of L-shaped arms 16 are tapered, and contain contact buttons 19, also constructed of a metallic material. Tapering of the extreme ends allows the contact to be of less width; the housing may have corresponding tapered sections. The result is that the interior space in the housing is reduced by the use of tapered contact ends. Contact buttons 19 are the points at which the movable contact 13 contacts with stationary contacts 11 and 12. Stationary contacts 11 and 12 have raised contact points 20 and 21 which are designed to engage contact buttons 19. Contact buttons 19 and raised contact points 20 and 21 are preferably constructed of a silver alloy, of any known type used in electrical connections. In the preferred embodiment, the contact is 0.25 inches high, 0.36 inches wide, cross-piece 17 is .164 inches long, and the contact has a flexural length FL of 0.615 inches.

The design of movable contact 13 is such that it provides increased flexural life and improved contact while minimizing the space used within the switch body interior. In designing a reciprocating switch with a movable bridging contact, it is necessary to provide a degree of "overtravel" to the movable contact. Overtravel is the continued movement of the switch actuator after electrical continuity has been created. Overtravel serves two purposes: it increases the force pressing the contacts together after an initial mating, and it compensates for variability in part sizes affecting the switch operation and external operating mechanisms. Thus, overtravel is necessary to ensure that a consistent, reliable electrical connection is made between the stationary contacts and the moving contact.

Figure 4:
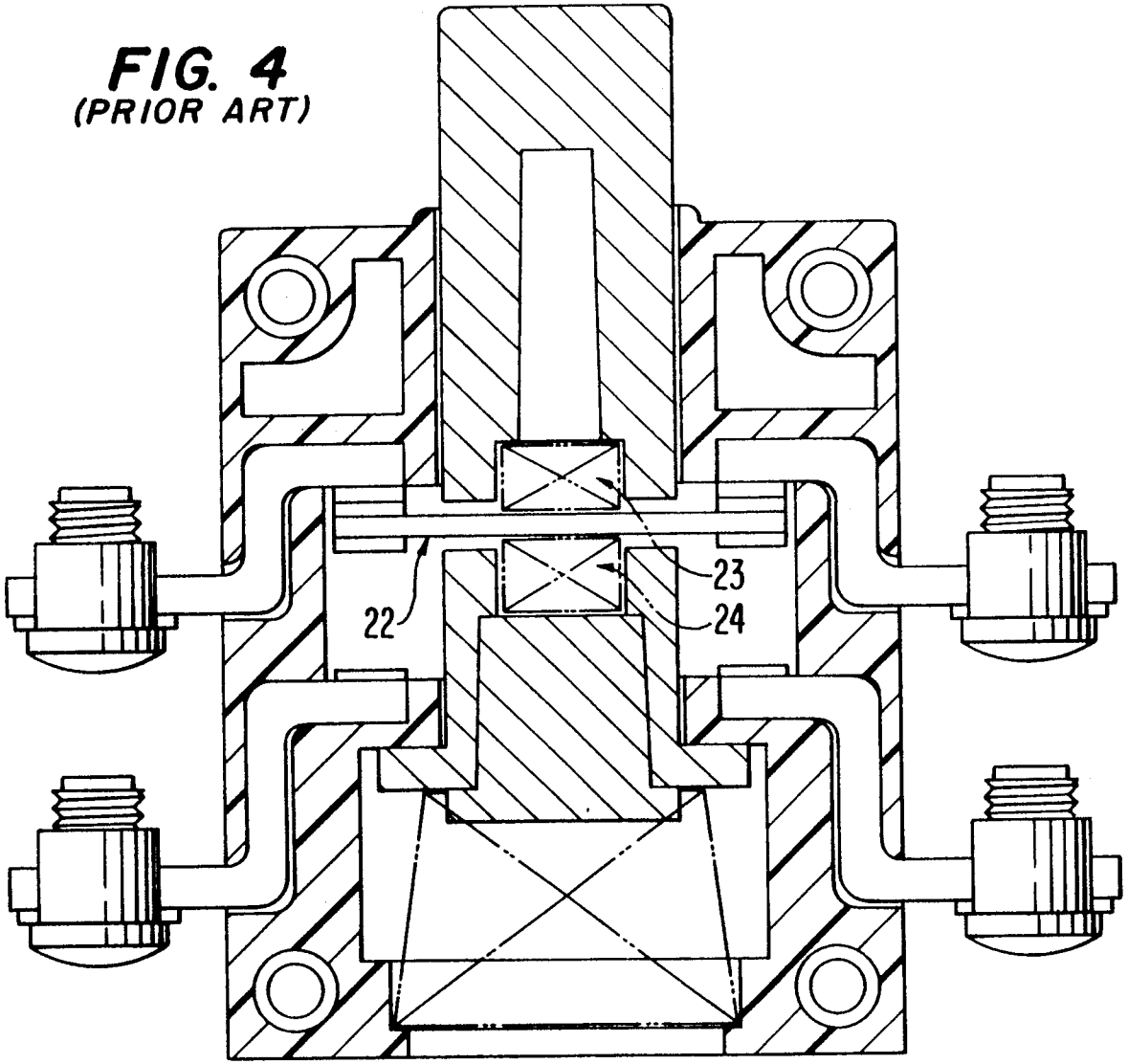
FIG. 4 (PRIOR ART)
FIG. 4 is a cross-sectional view of a prior art switch design.

The advantages of the instant design can best be seen by comparing it to a comparable prior art device. In prior art devices as shown in FIG. 4, overtravel is provided by sandwiching a movable contact 22 between two coil springs 23, 24, or by manufacturing the movable contact such that the contact arms are resiliently cantilevered and horizontally extending. The prior art design utilizing coil springs 23, 24 is disadvantageous because it requires several small parts to be assembled, which increases assembly costs, and overtravel is constrained by the relatively short length of the coil springs 23, 24. The prior design utilizing a flexibly cantilevered movable contact is disadvantageous because overtravel is relatively limited unless a fairly lengthy movable contact is used. Any increase in length of the movable contact requires the interior space to be larger, which is disadvantageous because it increases the overall size of the switch and the interior volume in which explosive gases or vapors might be exposed to electrical arcing.

In the movable contact 13 of the present invention, the combination of L-shaped arms 16 and cross-piece 17 provide a flexural length FL which is substantially greater than that in a straight-armed cantilever movable contact, without greatly increasing the interior volume of the switch housing. This is because a great deal of the flexural length FL of both arms is contained within the volume V above the stationary contacts containing movable plunger 14. As can be seen from FIG. 2, in a retracted position where the movable contact 13 engages the upper stationary contacts 11 more than half of the flexural length of the spring will be contained within this volume. The increased flexural length increases the degree of overtravel available, thus increasing the reliability of the electrical connection. The reduced volume used makes the switch smaller and thus adaptable to more space-restricted environments, and also allows a smaller amount of hazardous gas or vapor to come into contact with a potential electrical arc. The optimal amount of flexural length versus the minimal amount of increased interior volume is achieved when the switch is designed as shown in FIGS. 3*a* and 3*b*, with each section arranged perpendicular to its adjoining section, and the lengths of each section of the L-shaped arms 16 being approximately equal, with the cross-piece 17 being of relatively smaller length. Because the contact of the present invention does not need auxiliary springs for overtravel, but instead relies on its own flexibility, it is also easier to assemble and therefore less costly than devices requiring overtravel springs.

The design of the contact is also such that as the switch goes through overtravel, it causes the contact buttons 19 to slide across the contact points 20 or 21, thereby providing a "wiping" or cleaning-type action. This is because increased force on the movable contact 13 after initial engagement with the contact points 20 or 21 causes the L-shaped arms 16 to flex either inwardly or outwardly, causing the contact buttons to slide across the contact points 20 or 21. This wiping action increases the reliability of the electrical connection achieved by tending to eliminate any residue on the contacts.

Figure 5:
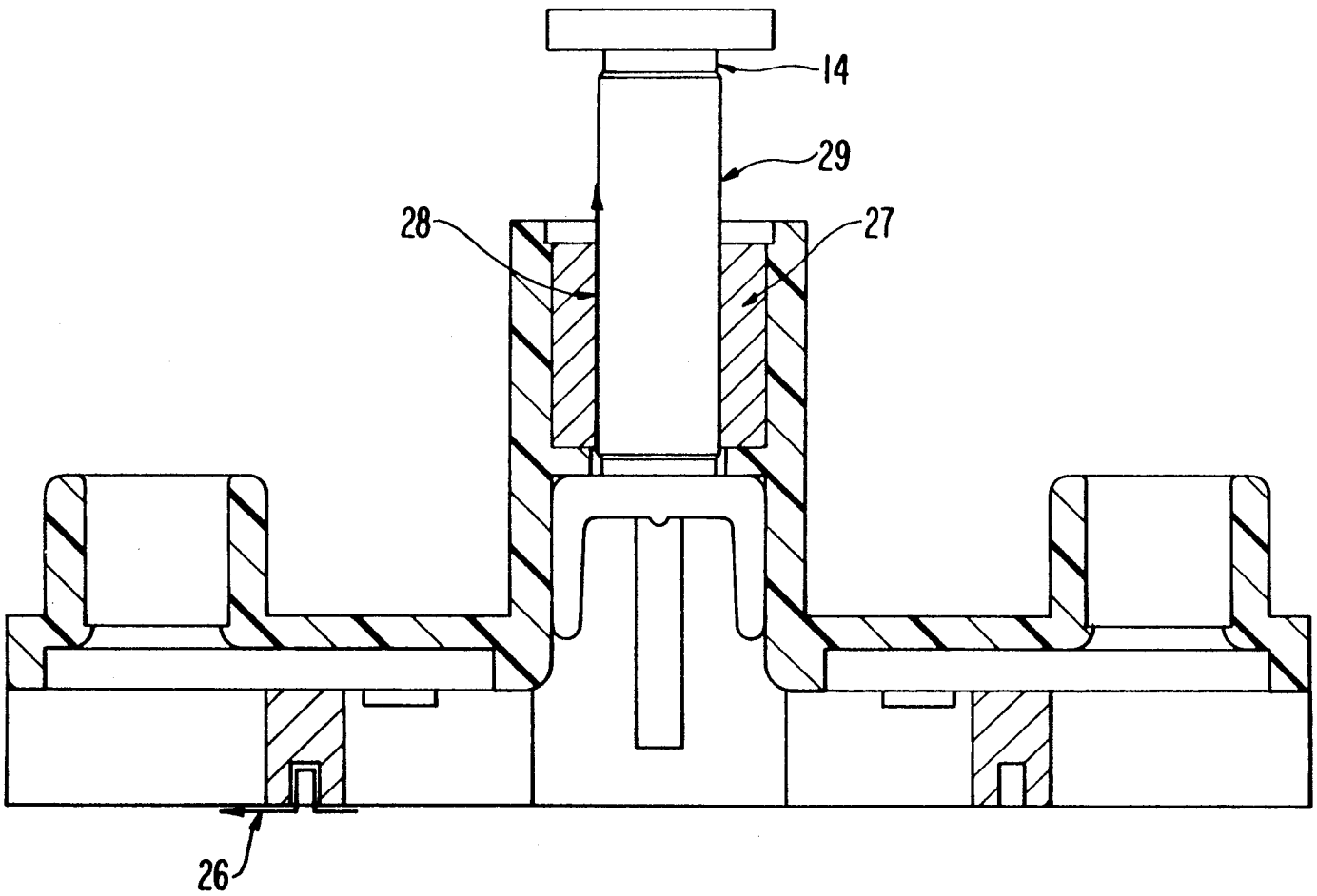
FIG. 5 is a cross-sectional view of the upper portion of the switch of the present invention.

FIG. 5 shows the provisions in the instant invention for preventing the ignition of hazardous vapors outside the switch body. In the present switch arrangement, there are two joints through which gases or vapors can pass both from the exterior environment to the switch interior, and vice versa. The area at which upper and lower switch housing members 1, 2 join creates a joint 25. In the present invention, switch housing members 1, 2 are normally constructed of a plastic material, although they could be constructed of any non-conductive material. If the housing members 1, 2 are constructed of a plastic material, it is necessary to provide a means for preventing any hot gases from escaping from an interior of the switch housing and igniting the exterior environment. These hot gases would be generated whenever explosive gases or vapors ingress to the interior of the switch housing and are ignited by an electrical arc caused by a switching action. To cool the hot gases sufficiently as they escape from the switch housing interior, the joint 25 is constructed as a labyrinth, such that the escaping gases pass through a path sufficiently long that they are cooled before they egress to the exterior atmosphere. The labyrinth is preferably constructed by providing mutually enmeshing ridges and valleys on the upper and lower housing members 1, 2. The flame path 26 is shown in FIG. 5.

The other joint through which vapors or gases may pass in the present invention is between the plunger shaft 14 and its housing bearing 27. Upon an arc ignition, hot gases would escape out of the switch body interior through path 28. The path is of sufficient length to cool escaping gases so that they will not ignite the outside environment. The joint is made such that the facing sides are both constructed of a metallic or a ceramic material. Plunger shaft can be encircled by a tubular sleeve 29, which slides in and out of upper switch housing 1 in a tubular bearing 27. The plunger shaft could also be made of a solid ceramic material. Metal or ceramic materials have a better resistance to wear caused by the movement of the plunger shaft. These materials are also more resistant to erosion of the joint by any hot expelled gases. The materials therefore prevent widening of the path, which could cause hot gases to escape without being cooled, presenting a hazard of explosion in the outside environment.

While the invention has been described with reference to a specific embodiment, it will be apparent to those skilled in the art that many alternatives, modifications, and variations may be made. Accordingly, it is intended to embrace all such alternatives, modifications that may fall within the spirit and scope of the appended claims.

What is claimed is:

1. An electrical switch comprising:

upper and lower housing portions;

an actuator shaft protruding out of one of the upper or lower housing portions;

stationary electrical contacts in both the upper and lower housing portions;

a resilient movable electrical contact attached to the actuator shaft and movable by the actuator shaft from a position contacting the stationary electrical contacts in the upper housing portion to a position contacting the stationary electrical contacts in the lower housing portion;

wherein the area between the upper and lower housing portions is characterized by a joint sufficiently long to cool any hot gases escaping from the interior of the switch, and the joint between the actuator shaft and the housing portion from which the actuator shaft protrudes is also characterized by a joint sufficiently long so as to cool any hot gases escaping from the interior of the switch;

and wherein at least a portion of the movable contact is substantially parallel to the direction of movement of the actuator shaft.

2. The electrical switch of claim 1, wherein:

the actuator shaft slides within a tubular bearing, constructed of a metal or ceramic material, in the housing portion from which the actuator shaft protrudes.

3. The electrical switch of claim 1, wherein:

the joint between the upper and lower housing portions is a labyrinthine path.

4. The electrical switch of claim 3, wherein:

the labyrinthine path is constructed of mutually enmeshing ridges and valleys on the upper and lower housing portions.

5. The electrical switch of claim 1, wherein:

the actuator shaft is spring biased into contact with the stationary contacts in one of the housing portions.

6. The electrical switch of claim 1, wherein:

the actuator shaft protrudes from the upper housing portion;

a portion of the actuator shaft is disposed in a volume of the interior of the upper housing portion extending above the stationary contacts in the upper housing portion; and at least half of the length of the movable contact is contained within said volume of the interior in which the actuator shaft is disposed when the movable contact is in contact with the stationary contacts in the upper housing portion.

7. The electrical switch of claim 1 wherein:

the movable contact is constructed of a sheet of electrically-conductive metallic material.

8. The electrical switch of claim 1 wherein:

the movable contact comprises two L-shaped arms and a cross-piece connecting the two L-shaped arms at one end of each of the L-shaped arms.

9. The electrical switch of claim 8 wherein:

the cross-piece is arranged perpendicularly to the one end of both the L-shaped arms.

10. The electrical switch of claim 9 wherein:

the cross-piece and L-shaped arms are constructed of an electrically conductive material such that when force is applied to the cross-piece after the other ends of the L-shaped arms are in contact with one of the stationary contacts the L-shaped arms flex across the stationary contact.

11. The electrical switch of claim 10, wherein:

contact buttons are affixed to the other end of the L-shaped arms.

12. The electrical switch of claim 11, wherein:

contact points are affixed to the stationary contacts.

13. The electrical switch of claim 12, wherein:

the contact buttons are wiped across the contact points when the L-shaped arms flex.

14. An electrical switch comprising:

an upper housing portion comprising:

two terminal contacts;

two stationary contacts electrically connected to a respective one of the terminal contacts;

an upstanding portion enclosing an interior volume above the stationary contacts;

a tubular metallic or ceramic bearing within the upstanding portion;

at least one ridge and at least one valley on the lower extremity of the upper housing portion;

a lower housing portion comprising:

two terminal contacts;

two stationary contacts electrically connected to a respective one of the terminal contacts;

at least one ridge and at least one valley on the upper extremity of the lower housing portion constructed to enmesh with the at least one ridge and at least one valley on the lower extremity of the upper housing portion;

a movable contact contained between the upper and the lower housing portions comprising:

two L-shaped arms;

a cross-piece connecting the two L-shaped arms at one end of each of the L-shaped arms;

contact buttons affixed to the other end of the L-shaped arms;

wherein the cross-piece is arranged perpendicularly to the one end of both the L-shaped arms, and the cross-piece and L-shaped arms are constructed of a resilient, electrically conductive material, such that when force is applied to the cross-piece after the other ends of the L-shaped arms are in contact with said stationary contacts in said upper housing or said stationary contacts in said lower housing, the L-shaped arms flex across said stationary contacts;

an actuator in engagement with said movable contact;

said actuator having an outer face of a metallic or ceramic material, said actuator sliding in said bearing, and said actuator being in engagement with said movable contact; and a spring in engagement with said lower housing and said actuator;

wherein at least one arm of said L-shaped arms extends substantially within said interior volume when said movable contact is in engagement with said stationary contacts in said upper housing.

* * * * *